United States Patent [19]

Damp et al.

[11] Patent Number: 4,601,605

[45] Date of Patent: Jul. 22, 1986

[54] ROADWAY SURFACE RECONDITIONING APPARATUS

[75] Inventors: Stephen P. Damp, Willowdale; Harvey G. Johnson, Toronto; Allen A. Neufeldt, Willowdale, all of Canada

[73] Assignee: Johnson Re-Cycling International Inc., Toronto, Canada

[21] Appl. No.: 674,974

[22] Filed: Nov. 26, 1984

[30] Foreign Application Priority Data

Jul. 20, 1984 [CA] Canada ..... 459344

[51] Int. Cl.[4] ..... E01C 23/14

[52] U.S. Cl. ..... 404/95; 404/77; 126/271.2 A; 126/343.5 A

[58] Field of Search ..... 404/95, 90, 77, 91, 404/89, 79, 83, 92; 126/271.2 A, 343.5 A

[56] References Cited

U.S. PATENT DOCUMENTS

| | | | |
|---|---|---|---|
| 1,076,782 | 10/1913 | Popkess | 404/95 X |
| 3,361,042 | 1/1968 | Cutler | 404/95 X |
| 3,801,212 | 4/1974 | Cutler | 404/95 |
| 3,989,401 | 11/1976 | Moench | 404/95 |
| 3,997,276 | 12/1976 | Jackson, Sr. | 404/77 |

FOREIGN PATENT DOCUMENTS

| | | | |
|---|---|---|---|
| 2915748 | 10/1980 | Fed. Rep. of Germany | 404/95 |

*Primary Examiner*—James A. Leppink
*Assistant Examiner*—Matthew Smith

[57] ABSTRACT

In a roadway surface reconditioning apparatus, for example, a scarifier for use with an asphalt or like bituminous roadway surface, a number of heaters of the luminous wall type are employed to direct large quantities of radiant heat downwardly towards the surface for softening it while travelling along the roadway. These heaters consist basically of porous fire bricks through which an air/propane mixture passes and on the surface of which it burns. Each heater also has porous side walls that project closer to the roadway surface than the main bricks and are supplied with air for forming a downward curtain of air to inhibit sideways escape of heat from the region beneath the heater. The heaters are assembled in banks that are spaced apart from each other in the direction of travel. This spacing can be adjusted. Each pair of adjacent banks is bridged by heat deflectors that help to provide heat soak areas between the heater banks. The apparatus also includes a novel scarifying assembly with increased adjustability of the scarifying depth of the teeth.

9 Claims, 11 Drawing Figures

ROADWAY SURFACE RECONDITIONING APPARATUS

BACKGROUND OF THE INVENTION

This invention relates to roadway surface reconditioning apparatus and more specifically to a machine for scarifying and in-place recycling of asphalt or like bituminous road surfaces.

The term "scarifier" is used herein to denote a machine that travels slowly along a roadway while heating the existing asphalt to a relatively high temperature. It then loosens the hot asphalt with a scarifying assembly to a depth of typically about an inch. Finally it smooths down the loosened hot material to form a reconditioned and resurfaced roadway. In some cases a liquid rejuvenator and/or new asphalt can be added before the smoothing stage. The scarifier is followed by a roller for further compressing the material while it is still relatively hot.

A typical prior scarifier is disclosed in U.S. Pat. No. 3,989,401 issued Nov. 2, 1976 to F. F. Moench.

A critical part of such a machine is a heater assembly for applying heat to the old roadway surface. It is desirable to apply as much heat as possible to the asphalt, and to do so as quickly as possible, because the amount of heat that can be transferred to the asphalt per unit time will determine how fast the machine can travel along the road and hence how many miles of road one machine can treat in a day. The efficiency of heat transfer will also determine the depth to which the asphalt can be heated to the extent required to enable it to be loosened by the scarifying teeth. For example, existing machines can typically travel at about 15 feet per minute, based on treating at the most the top one inch of asphalt. Such operation would require a maximum heater output of about 60,000 BTU per square foot per hour.

Many past attempts to increase the amount of heat transferred to the roadway surface have resulted in either setting fire to the asphalt or burning it to such an extent that it could no longer be reused without extensive reconditioning. Machines of this type have also been blamed for starting fires among shrubs and other vegetation along the side of the road, due to uncontrolled excessive heat.

Another problem that has been experienced in these machines in the past is adaption of the scarifying assembly to variations in roadway surface conditions, especially irregular profiles and widths.

SUMMARY OF THE INVENTION

An object of the present invention is to provide a heater assembly for use in such a machine, such assembly being capable of transferring heat to the roadway material more effectively and efficiently than has been possible with past machines. Such an improved heater assembly is expected to permit a heat transfer of as high as 150,000 BTU per square foot per hour when needed, with a typical daily operating transfer rate of the order of 80 to 100,000 BTU per square foot per hour, and moreover to achieve these rates without burning the material or otherwise seriously deteriorating its quality and without subjecting the surroundings to the risk of brush fires or the like. With such a high heat transfer rate, it is possible to operate the machine at a speed of up to about 25 feet per minute and/or to increase the scarifying depth to as much as about 1½ inches with a consistent minimum of an inch, even at the edges of the machine, which is a location at which it is often difficult to achieve full performance.

Another object of the present invention is to provide an improved scarifying assembly for loosening the roadway surface after it has been softened by heating and prior to its being resmoothed, and in particular to provide a scarifying assembly that is versatile in enabling the operator to adapt it to variations in roadway conditions while scarifying to the full depth of the heated asphalt.

DETAILED DESCRIPTION OF THE PREFERRED EMBODIMENT

Figures 1, 2:
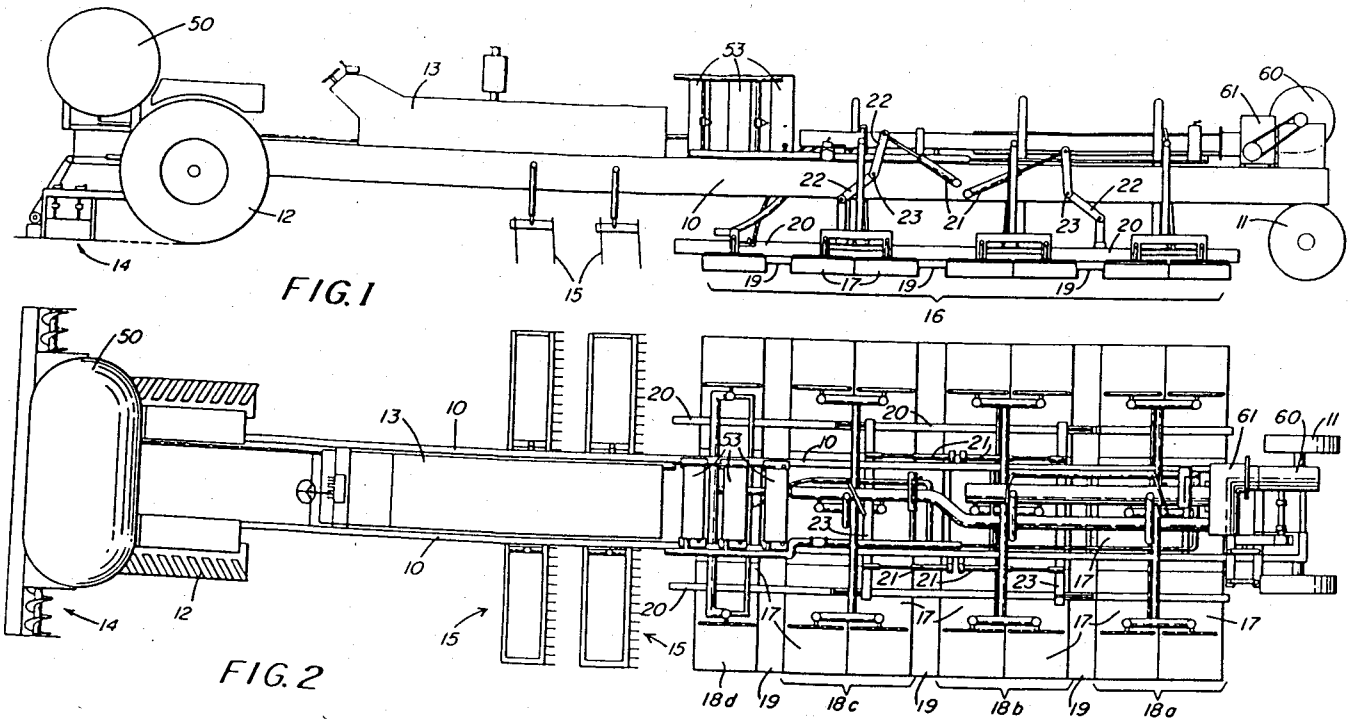
FIG. 1 shows a side view of a scarifier embodying the present invention.
FIG. 2 is a plan view of FIG. 1.

The machine shown in FIGS. 1 and 2 is a vehicle having a main frame formed by a pair of horizontal beams 10 mounted on front wheels 11 and rear wheels 12 driven from an engine unit 13. At the extreme rear there is a conventional screed assembly 14 for smoothing the material that has been broken up by scarifying teeth 15 after heating by a heater assembly 16.

The heater assembly 16 consists of twenty one heater units 17 arranged in three forward and intermediate banks 18*a*, 18*b* and 18*c* of six units each and a rearmost bank 18*d* of three units. In each bank, three units 17 are arranged end to end to form rows extending across the machine. In the forward and intermediate banks there are two such rows, one in front of the other, and in the rearmost bank there is only one such row. Heat deflectors 19 are provided between adjacent banks 18*a* to *d*. As explained more fully below these heat deflectors 19 serve to reflect or reradiate heat down towards the roadway.

The heater banks are secured to and supported by horizontal beams 20 and can be raised and lowered as an assembly by the operator by means of hydraulic cylinders 21 mounted on the main beams 10 and acting through linkage systems 22 and transverse bars 23 pivotally mounted on the main beams 10. By operating one cylinder 21 more than the other this assembly can be tilted forward or backwards to vary the distance between the ground and either the forward or rearward heater banks.

Figure 7:
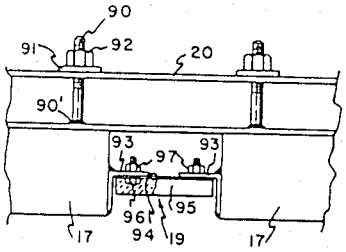
FIG. 7 is a fragment of FIG. 1 showing details on a much enlarged scale.

As shown in FIG. 7, each heater unit 17 is secured to the beams 20 by means of pairs of bolts 90 (one behind the other in FIG. 7) which are welded to the heater unit 17 at 90' and extend upwardly to pass through a transverse bar 91 extending across the top of the beam 20. This arrangement is secured by nuts 92. Each heat deflector 19 preferably consists of a steel back plate 94 to which a refractory panel 95 is adhered (although a plain steel sheet can be used). Along each edge, bolts having heads 96 embedded in the refractory panel 95 serve with nuts 97 to secure the plate 94 to steel angle beams 93 welded to the sides of the heater units 17.

This arrangement permits easy variation of the spacing between the heater banks in the direction of travel. The nuts 92 are loosened, and the nuts 97 and the deflectors 19 are removed. One or more of the heater banks is then moved along the beams 20 to a desired new location and the nuts 92 retightened. New deflectors 19 dimensioned to fit the new spacing between the heater banks are then secured in place by the nuts 97.

Figure 5:
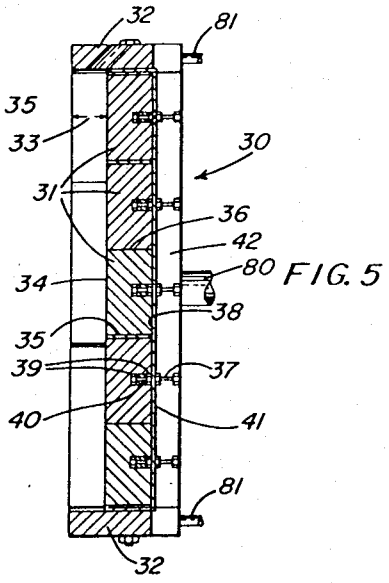
FIG. 5 is a sectional view on the line V—V in FIG. 4.
Figure 4:
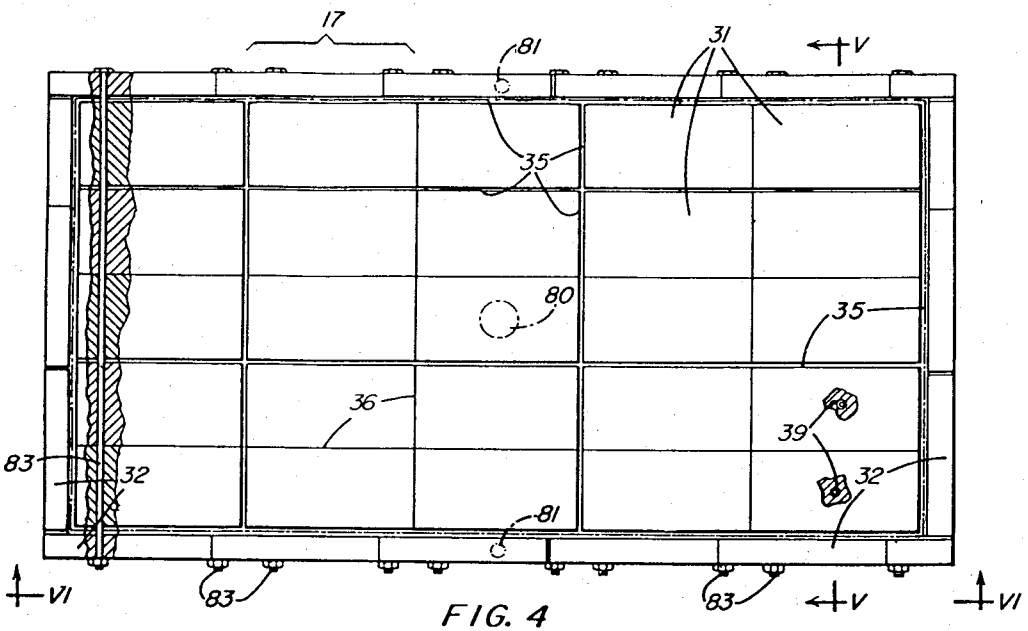
FIG. 4 is an underside view of a heater unit, partly broken away.
Figure 6:
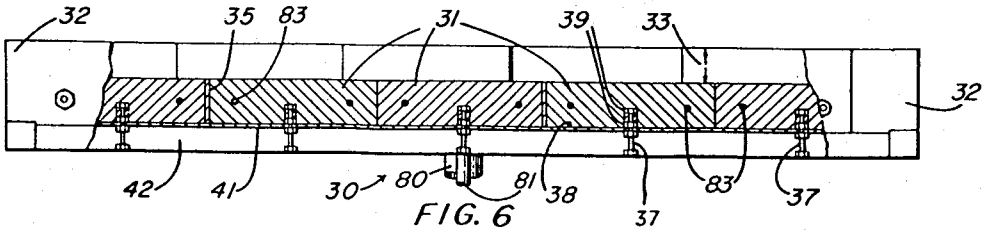
FIG. 6 is a partly broken away side view taken on the line VI—VI in FIG. 4.

Each of the heater units 17, shown individually in FIGS. 4 to 6, consists of a heater of the so-called luminous wall type, consisting of a steel frame 30 supporting a series of porous firebricks 31. These bricks 31 are so designed that a gaseous fuel consisting of a mixture of propane and air introduced into a hollow rear space 42 of the frame 30 through a pipe 80 can flow through the bricks 31 and burn at or adjacent the surfaces thereof to provide a large area radiant heater. Around the perimeter of the frame 30 there are raised porous edge members 32 that serve to ensure a minimum spacing 33 between the heater surface 34 and a roadway surface. All the edge members 32 are connected to an air supply by pipes 81 and hence serve to discharge downwardly a curtain of air around the entire unit 17. This arrangement tends to minimise the risk of combustible fuel or flames escaping sideways from the unit and presenting a threat to persons or objects in the vicinity. It also cools and hence protects the steel frame.

Expansion material 35, preferably in the form of a composition of the aluminum silicate type, such as that known under the trade mark Kaowool, is located around the entire assembly of twenty five bricks 31 and between and around the individual bricks 31 in such a way that every brick has this material extending along at least two adjacent sides thereof. In other words, each brick has freedom to expand and contract in both directions with temperature changes. At those locations where the bricks abut each other without interposed expansion material 35 they are joined by mortar 36. Each brick 31 is securely connected to the frame 30 by means of a centrally located bolt 37 (the centre brick has two such bolts arranged one on each side of the pipe 80) that extends through the frame 30 and through four layers of wire mesh 38 to engage nuts 39 firmly mounted in the centre of each brick by mortar 40. The surface of the frame 30 facing the wire mesh 38 and the bricks 31 is in the form of a perforated plate 41 through which the fuel mixture can flow to reach the bricks. Finally, the bricks are held in place by transverse rods 83 two of which pass horizontally through each brick and are tightly fastened by nuts on the outer sides of the frame 30.

Figure 3:
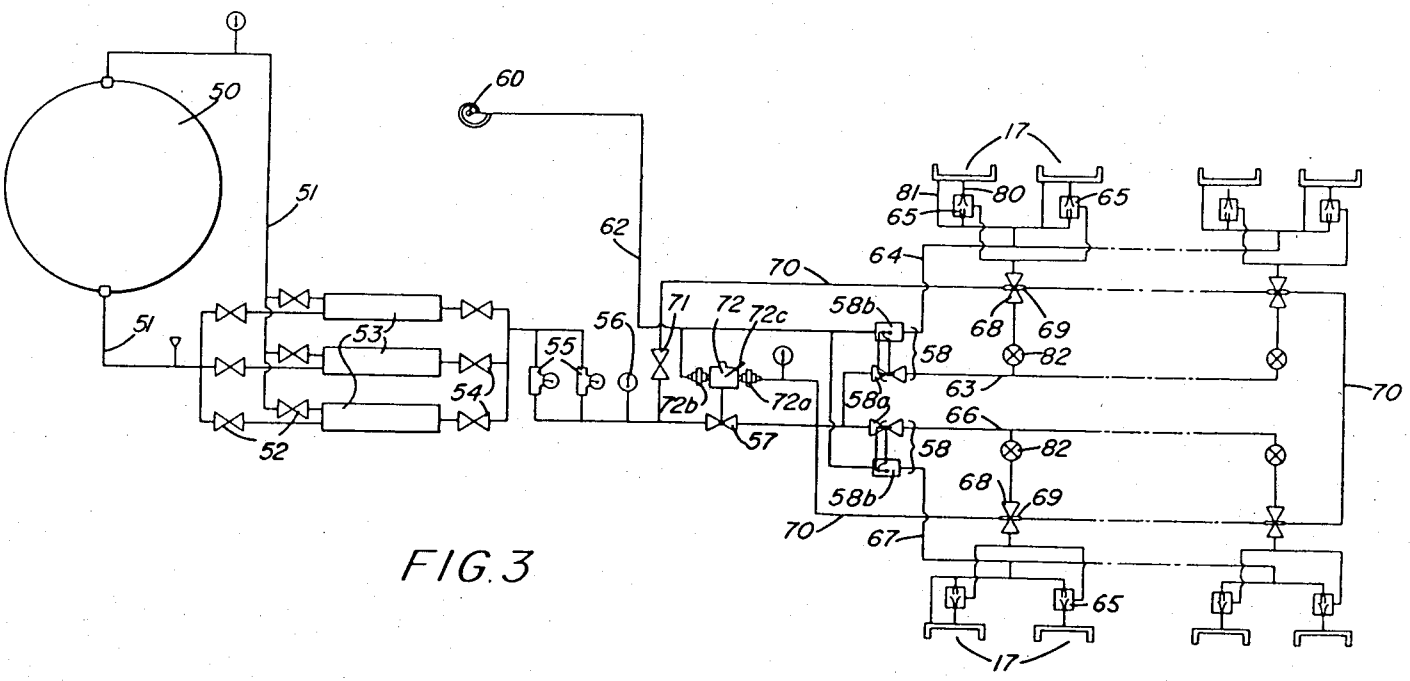
FIG. 3 is a schematic diagram of the fuel supply to the heater assembly.

It will now be convenient to refer to FIG. 3 which shows the air-fuel system schematically. This system consists of a propane tank 50 from which liquid and gaseous propane is drawn off in the usual way through piping 51 and valves 52 to a bank of three vaporizers 53 arranged in parallel. At valves 54 on the downstream side of the vaporizers 53 there will be gaseous propane at a pressure of about 100 pounds per square inch. This gas passes through a pair of parallel-arranged, gas pressure regulators 55 where its pressure is reduced to about 5 pounds per square inch, as indicated by a gauge 56. It then passes through a safety shut-off valve 57, the function of which will be described below, to gas portions **58*a* of a pair of ratio valves 58**.

The air system begins at a blower 60 driven by a motor 61 (FIGS. 1 and 2) that supplies air in pipe 62 to air portions **58*b* of the ratio valves 58. These known valves can be manually operated to control the exact amount of heat emitted by either of the two portions (shown at the top and bottom respectively of FIG. 3) into which the heater assembly is divided. Regardless of the position, i.e. degree of opening, of each valve 58, the ratio between the amount of propane gas and the amount of air passed through the respective valve portions 58*a* and 58*b* always remains constant. Of course, this ratio can be changed as desired and will initially be set by the operator. However, once so set it will be maintained automatically, regardless of the degree of opening of each of these valves. These valves 58** can alter the total heat from 30,000 B.T.U. per square foot per hour to 150,000 B.T.U. per square foot per hour, while maintaining uniform application of that heat.

The upper pair of valve portions **58*a* and 58*b* seen in FIG. 3 supply gas and air through respective pipes 63 and 64 to a first series of gas-air proportional mixers 65. One such mixer is mounted on top of each heater unit 17 of the nine such units of banks 18*c* and 18*d* (represented by the four upper units 17 shown in FIG. 3). Similar pipes 66 and 67 respectively supply gas and air from the lower pair of valve portions 58*a* and 58*b* to a second series of similar gas-air proportional mixers 65 mounted on top of respective ones of the twelve heater units 17 of the front banks 18*a* and 18*b* (represented by the four lower units 17 shown in FIG. 3). The supply lines 63 and 66 pass gas to the mixers 65 through individual, manually operated, control valves 82 and shut-off valves 68. Each valve 68 also includes a second, transverse passage 69, the respective passages 69 being arranged in series in a line 70 that extends from the gas supply through a manual valve 71 and ends at a control mechanism 72 controlling the safety valve 57. Initially, before any of the heater units 17 can be started up, all the valves 68 must be closed in respect of the lines 63 and 66. When they are all thus closed, their passages 69 will all be open, and hence the line 70 will be open, allowing gas pressure to pass through the valve 71 and the line 70 to the gas pressure side 72*a* of the control mechanism 72**.

Assuming that there is simultaneously air pressure from the line 62 on the air pressure side **72*b* of the control mechanism 72, this mechanism is enabled for manual operation by a lever 72*c* to open the safety valve 57 and admit gas to the ratio valves 58 and hence eventually to the heater units. So long as gas pressure is maintained between the valves 57 and 58 and there is air pressure in the line 62, the control mechanism 72 will remain in the open condition without reliance on pressure from the line 70. Thus, as part of the start-up procedure, the valve 71 can now be closed manually and each of the valves 68 can be opened manually with the gas-air mixture that now flows in lines 80 and appears at the respective heater units 17 being ignited. In practice, the valves 68 will preferably be ganged in groups of three across the machine. If, at any time while the machine is operating, there should be a loss of gas or air pressure on either side of the control mechanism 72, such loss will automatically shut off the safety valve 57 which cannot then be reopened manually until both the gas and air pressures have been restored. In the case of the gas pressure, such restoration must be achieved by use of the valve 71 and line 70 which necessitates first opening all the passages 69, i.e. closing all the valves 68** to shut down the entire heater assembly. Hence, for reasons of safety, no heater unit can be relit until all of them have been shut down and the two pressures (gas and air) reestablished.

The manually operable valves 82 enable the operator to adjust the amount of heat being given off by one pair of heaters 17 relative to each other pair. In this way the apparatus enables the operator to compensate for any temperature gradient that might arise in the transverse direction of the machine as a result, for example, of an uneven roadway surface, an off-level condition of the machine or different edge spacings (heights) from the road surface. These valves also allow the operator to shut off a complete row of heaters from front to back, being either the left, center or right row, so that with suitable adjustments to the scarifying and screed assemblies, the machine can quickly be converted to scarify a variety of widths of roadway.

While an important feature of the overall assembly that constitutes the present invention is the use of the luminous wall type of heater, it should be explained that this type of heater is already known per se for use in radiant heating applications, for example in U.S. Pat. Nos. 2,828,813 issued Apr. 1, 1958 to A. F. Holden; 3,008,513 issued Nov. 14, 1961 to A. F. Holden; 3,076,605 issued Feb. 5, 1963 to A. F. Holden and 3,224,431 issued Dec. 21, 1965 to A. F. Holden, and has been disclosed for use in a scarifier in U.S. Pat. No. 3,970,404 issued July 20, 1976 to A. W. Benedetti.

Figure 8:
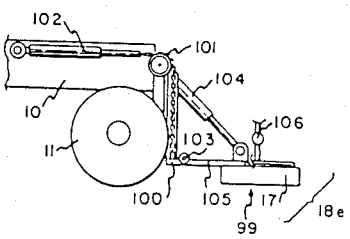
FIG. 8 is a side view of a portion of FIG. 1 showing a modificiation.
Figure 9:
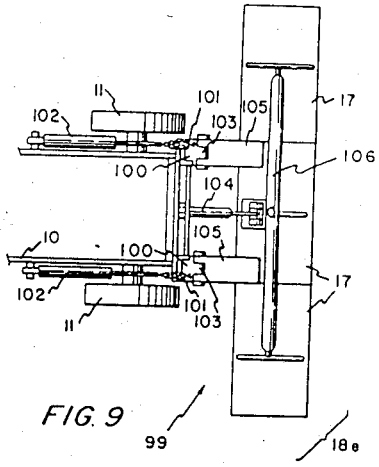
FIG. 9 is a plan view of FIG. 8.

FIGS. 8 and 9 show an optional additional feature in the form of a preheater assembly 99 mounted on the front of the vehicle, i.e. forward of the front wheels 11. This assembly 99 consists of a frame 100 slidably mounted on the vehicle for vertical movement under the control of chains 101 operated by hydraulic cylinders 102. The frame 100 supports arms 105 on hinges 103. The arms 105 carry a fifth bank **18*e* of heater units 17 similar to the heater bank 18*d*. Further vertical and tilting adjustment of the orientation of the heater bank 18*e* is achieved through hydraulic cylinder 104. Gas and air are supplied to the assembly 99 through tubing 106** (only partially shown) in the same manner as to the other heater banks.

The assembly 99 will be stored in a vertical orientation (by retraction of the cylinder 104). The cylinders 102 and 104 will be operator controlled and when the assembly is in use these cylinders will adjust the orientation of the heater bank **18*e*** and the distance between its heating surfaces and the roadway surface.

The present inventors have found that the improved results postulated above can be achieved with the apparatus disclosed herein, and that important aspects of this apparatus for obtaining these results are use of the luminous wall type of heaters including not only a radiating surface of porous fire bricks 31 supplied with air/gas mixture but also porous side walls 32 for directing curtains of air downwardly to inhibit sideways escape of heat from the region beneath each heater, and the assembling of the heaters into at least two banks of heaters (and preferably as many as the four such banks **18*a* to 18*d* plus the addition of the preheater assembly 18*e*, when required), these banks being spaced apart in the travelling direction and bridged by the heat deflectors 19 and such spacing being adjustable in length. In addition to reducing the heat loss upwardly between the heater banks, these deflectors either reflect or reradiate heat back down to the portion of the roadway surface that is momentarily located between the heater banks. This arrangement achieves an important heat soak stage. Each heater bank projects very intense heat down against the roadway surface beneath it. This heat needs some time to penetrate to the desired depth. If the intense heat were continued uninterruptedly, i.e. if there were no spacing between the heater banks in the travelling direction, the upper surface of the roadway could be damaged by reaching too high a temperature (or the rate of application of heat would have to be reduced, which would defeat the basic objective). Hence the spacing between heater banks is essential in order to give the road surface a soaking period for the heat to penetrate. On the other hand, it is desirable to minimise the escape of heat during this soaking period. This is the important function that the heat deflectors 19** play.

The freedom provided by the present arrangement to vary the spacing between a pair of heater banks and hence the size of the heat deflectors 19 bridging such pair of banks together with the other variables already discussed, such as varying the amount of fuel to each heater and the height of respective heaters above the roadway, combine to enable choice of an optimum relationship between the magnitude and duration of each heat application by a heater bank and the magnitude and duration of each heat soak period when the roadway surface is directly receiving only the deflected heat from the deflectors 19, such optimum relationship depending on the asphalt type, roadway condition, the depth of scarifying required and seasonal variations of ambient temperature.

As indicated above, the rate of heat application can be adjusted by changing the height of the heater banks above the roadway surface. With very cold seasonal temperatures, the front of the heater assembly is lowered close to the roadway surface to give maximum heat penetration into the initially very cold asphalt. On the other hand, if the machine encounters a roadway with extensive prior crack filling, the rear of the heater assembly can be raised further above the roadway surface, since the crack-sealing material would otherwise tend to burn before the asphalt is fully heated.

The preheater assembly 99 is normally used when cold weather conditions or certain asphalt types that are more difficult to heat are encountered.

The use of heat shields in a road maintenance machine is known from U.S. Pat. No. 3,997,276 issued Dec. 14, 1976 to J. A. Jackson, Sr.

Figure 10:
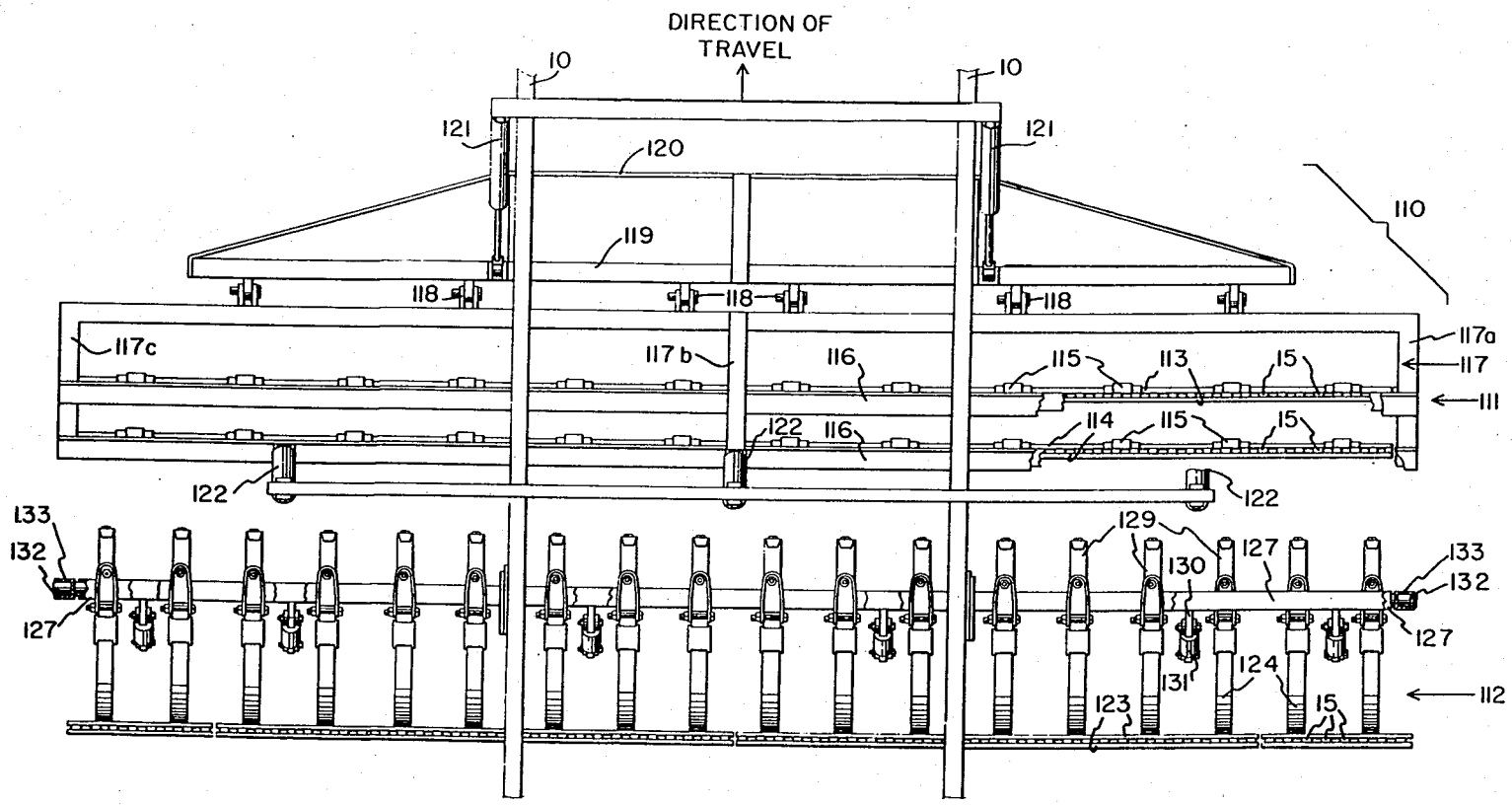
FIG. 10 is a plan view of a scarifying portion of FIG. 1 showing on an enlarged scale another modification.
Figure 11:
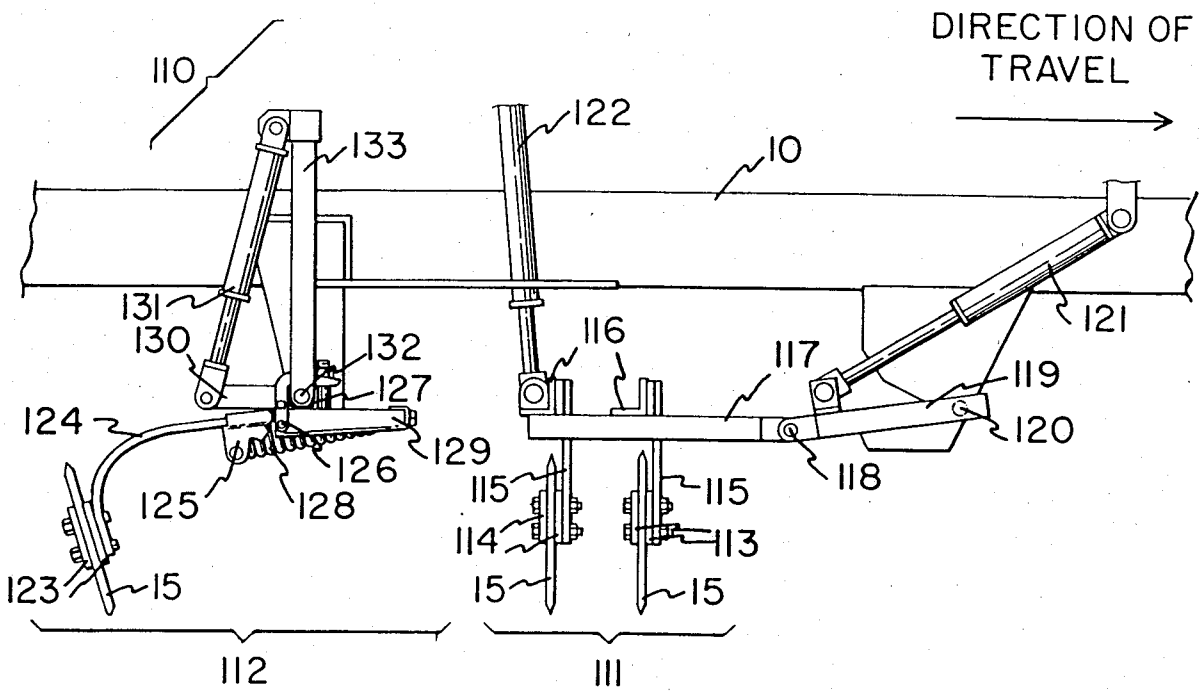
FIG. 11 is a side view of FIG. 10.

As shown in FIGS. 10 and 11, the apparatus may include a modified scarifying assembly 110 consisting of a forward portion 111 and a rear portion 112. The forward portion 111 has transverse bars 113 and 114 mounting staggered rows of conventional scarifying teeth 15. Each bar 113, 114 is mounted by means of straight leaf springs 115 on an upper cross bar 116 forming part of a main frame 117. In practice this frame (and its associated parts) will be divided in the transverse direction into at least two and preferably three separate sections. There will thus be three separate frames **117*a*, 117*b* and 117*c*, each of which at its front edge swivels about pins 118 carried by a forward frame 119 which itself can pivot on an axis 120 about the vehicle frame members 10. Pivoting movement of the forward frame 119 is controlled by hydraulic cylinders 121, and pivoting movement of the associated main frames 117***a*, 117*b* and 117*c* about the front frame 119 is controlled by hydraulic cylinders 122. As a result, the operator can control both the scarifying depth and the angle of attack of the teeth 15 of the forward scarifying portion 111 and he can adjust these requirements differently in sections across the machine.

The rear scarifying portion 112 is also divided transversely into a plurality of sections, and in this case the preferred number is six. Each such section has a transverse bar 123 mounting a row of conventional scarifying teeth 15. The bar 123 is mounted on lower ends of curved leaf springs 124, the upper end of each such leaf spring 124 being connected to one arm of a bell-crank member 125 pivoted about a pin 126 to a main cross beam 127. The other arm of each bell-crank member 125 is secured to one end of a coil spring 128 mounted at its other end to a casing 129 projecting forwardly from the beam 127 and also serving to partially shield the spring. Each section of the beam 127 carries an arm 130 to enable a hydraulic cylinder 131 to rotate such beam section about a pivotal axis 132 defined by arms 133 secured to the main frame of the vehicle. The operator can adjust the scarifying depth of the teeth 15 of each section of the rear scarifying portion 112 by means of respective cylinders 131. Also, each section can flex upwardly if excessive resistance is encountered by any of its teeth, such flexure being principally provided by stressing the coil springs 128 in tension.

The rear scarifying portion 112 is preferably divided into a larger number of transversely separate sections, e.g. 6, than the forward scarifying portion 111, e.g. 3 (although these numbers can be varied to suit different requirements), because the rear portion 112 is the one that principally determines the overall depth of scarifying. If the machine encounters a roadway surface with a drastically varying surface profile, it requires the versatility to adapt to such profile while still performing reasonably uniform scarification.

We claim:

1. In a roadway surface reconditioning apparatus, a heater assembly for mounting in a location closely above an asphalt or like bituminous roadway surface for directing large quantities of radiant heat downwardly towards such surface for softening the same for subsequent scarifying, and mobile support means for causing said heater assembly to travel along the roadway in such location;

wherein the heater assembly comprises (a) a plurality of luminous wall heaters each mounted in a steel frame, each supplied with air/gas mixture and each consisting of a plurality of porous fire bricks through which such mixture passes and on the downwardly facing surfaces of which such mixture burns to direct radiant heat to the roadway surface, each heater further having porous side walls projecting closer to the roadway surface than said bricks and supplied with air for forming a downward curtain of air to inhibit sideways escape of heat from the region beneath the heater and to cool and protect the steel frame, (b) said heaters being assembled into at least two banks of heaters, each bank extending in the transverse direction across the apparatus, and the banks being spaced apart from each other in the direction of travel along the roadway to provide a heat soak area between these two banks, (c) heat deflectors extending for the full length of the heater banks in said transverse direction and bridging the two heater banks in the travel direction whereby to return heat to those parts of the roadway surface that are momentarily located between the heater banks as the apparatus travels along the roadway and to protect portions of the apparatus above the heaters and the surrounding environment from the heat, and (d) means mounting said heater banks on said mobile support means to be adjustable in the travel direction and for changing the size of the heat deflectors in the travel direction for varying the spacing between the banks of heaters and hence the length of such soak area in the travel direction for accommodating the apparatus to variations in the nature and dimensions of the roadway surface, the depth of scarification required and ambient temperature, (e) said heat deflectors bridging all the heater banks in the travel direction whereby uninterruptedly from one end of the heater assembly to the other heat is directed downwardly towards the roadway surface and portions of the apparatus above the heaters are protected.

2. Apparatus according to claim 1, wherein the steel frame of each said heater supports an array of rows of said fire bricks to form a common, substantially planar, downwardly facing surface, and including means for securing said bricks in the frame, such securing means including a series of bolts extending into individual bricks from a rear surface of the frame and a series of rods extending transversely through each row of said bricks from one side surface of the frame to the other.

3. Apparatus according to claim 2, including expansion material arranged between bricks in the array so that every brick has such expansion material extending along at least two adjacent sides thereof whereby to have freedom to expand in both directions of the array.

4. Apparatus according to claim 1, wherein the heaters are assembled into four said banks, the heat deflectors extending between each pair of adjacent banks.

5. Apparatus according to claim 1, including means for varying the spacing between the heater assembly and the roadway surface, said means enabling independent control of such spacing at the front and rear of the assembly in the travel direction.

6. Apparatus according to claim 1, including a preheater assembly comprising a further, similar bank of heaters extending in the transverse direction across the apparatus, and means retractably mounting said preheater assembly on the mobile support means ahead of the main heater assembly for providing additional heating to the roadway surface.

7. Apparatus according to claim 1, including a system for supplying the air/gas mixture to the heaters, such supply system comprising an air supply and a gas supply and at least one ratio valve for maintaining the ratio between the air and the gas constant with variations in the flow of the mixture.

8. Apparatus according to claim 7, including a series of shut-off valves arranged in lines supplying the propane to respective heaters, each such shut-off valve having a main passage in a said supply line and a secondary passage that is open when the main passage is closed and vice versa, the secondary passages of the shut-off valves being arranged in series as a loop, there further being provided a safety valve in the gas supply and a mechanism for controlling such safety valve, such control mechanism having a first portion sensitive to pressure in the air supply and a second portion sensitive to pressure in the gas supply at a location downstream of said safety valve and permitting the safety valve to be open only in the presence of both such pressures, and a manually operable valve for admitting gas pressure to the loop through the shut-off valves to flow to the second portion of the control mechanism to enable initial opening of the safety valve for start up only when all the shut-off valves are in the position in which their main passages are closed.

9. Apparatus according to claim 7, including means for independently varying the air/gas mixture supplied to the heaters of separate rows of such heaters extending in the travel direction whereby to accommodate the apparatus to different widths of roadway surface.

* * * * *